US005749547A

United States Patent [19]

Young et al.

[11] Patent Number: 5,749,547

[45] Date of Patent: May 12, 1998

[54] CONTROL OF MODEL VEHICLES ON A TRACK

[75] Inventors: Neil P. Young, 3240 Bear Gulch Rd., Redwood City, Calif. 94062; David Hampton, Nevada City, Calif.

[73] Assignee: Neil P. Young, Redwood City, Calif.

[21] Appl. No.: 514,052

[22] Filed: Aug. 11, 1995

Related U.S. Application Data

[63] Continuation-in-part of Ser. No. 134,102, Oct. 8, 1993, Pat. No. 5,441,223, which is a continuation-in-part of Ser. No. 833,869, Feb. 11, 1992, Pat. No. 5,251,856.

[51] Int. Cl.[6] ..... B61L 7/08; B61L 27/00

[52] U.S. Cl. ..... 246/4; 246/187 A; 104/300; 104/302; 446/455; 340/825.69

[58] Field of Search ..... 246/3, 4, 5, 167 R, 246/187 R, 182 R, 187 A, 187 B, 191, 192 R, 193, 194, 196; 180/167; 104/295, 296, 297, 300, 301, 302, DIG. 1; 340/825.17, 825.07, 825.58, 825.69, 825.72, 310.01; 446/433, 443, 454, 455, 456, 467

[56] References Cited

U.S. PATENT DOCUMENTS

| | | | |
|---|---|---|---|
| 2,606,281 | 8/1952 | Thomas et al. . | |
| 2,622,542 | 12/1952 | Bonanno . | |
| 2,830,148 | 4/1958 | Barger . | |
| 2,963,985 | 12/1960 | Palmer et al. . | |
| 3,220,356 | 11/1965 | Leslie . | |
| 3,529,216 | 9/1970 | Kolm et al. . | |
| 3,587,100 | 6/1971 | Doremus et al. . | |
| 3,675,586 | 7/1972 | Haddad . | |
| 3,810,099 | 5/1974 | Woods . | |
| 3,964,701 | 6/1976 | Kacerek | 246/187 B X |
| 4,207,569 | 6/1980 | Meyer . | |
| 4,334,221 | 6/1982 | Rosenhagen et al. . | |
| 4,572,996 | 2/1986 | Hanschke et al. | 446/455 X |
| 4,711,418 | 12/1987 | Aver, Jr. et al. . | |
| 4,723,737 | 2/1988 | Mimoun . | |
| 4,914,431 | 4/1990 | Severson et al. | 246/187 B X |
| 5,146,153 | 9/1992 | Luchace et al. . | |
| 5,184,048 | 2/1993 | Severson et al. . | |
| 5,493,642 | 2/1996 | Dunsmuir et al. . | |

OTHER PUBLICATIONS

Excerpt from Lionel Brochure entitled "Lionel 'E Units'" pp. 231–234.

Copy of Marklin—Digital, Gebr. Marklin & Cie, GmbH, Postfach 8 60/8 80, D–7320 Goppingen, Germany.

K. Thompson, "Command Control Roundup," *Model Railroader*, pp. 88–93 (Jul., 1993).

*Primary Examiner*—S. Joseph Morano

*Attorney, Agent, or Firm*—Rader, Fishman and Grauer, PLLC

[57] ABSTRACT

A controller for model trains on a train track is provided. The controller causes direct current control signals to be superimposed on alternating current power signals to control effects and features on model vehicles. The model vehicle includes a receiver unit responsive to the direct current control signals.

13 Claims, 10 Drawing Sheets

CONTROL OF MODEL VEHICLES ON A TRACK

RELATED APPLICATIONS

This application is a continuation-in-part of application Ser. No. 08/134,102, filed Oct. 8, 1993 now U.S. Pat. No. 5,441,223, which is a continuation-in-part of application Ser. No. 07/833,869, filed Feb. 11, 1992 now U.S. Pat. No. 5,251,856.

BACKGROUND OF THE INVENTION

The present invention relates to control systems for model trains. In particular the present invention relates to a transitional command and control scheme supporting conventional vehicles as well as newer vehicles having more sophisticated on board control circuitry.

Model train systems have been in existence for many years. In the typical system, the model train engine is an electrical engine which receives power from a voltage which is applied to the tracks and picked up by the train motor. A transformer is used to apply the power to the tracks. The transformer controls both the amplitude and polarity of the voltage, thereby controlling the speed and direction of the train. In HO systems, the voltage is a DC voltage. In Lionel systems, the voltage is an AC voltage transformed from the 60 Hz line voltage available in a standard wall socket.

In addition to controlling the direction and speed of a train, model train enthusiasts have a desire to control other features of the train, such as a whistle. Lionel allows for such control of the whistle by imposing a DC voltage on top of the AC line voltage, which is then picked up by the locomotive. Obviously, this method is limited in the number of controls that can be transmitted, since there are only plus and minus DC levels available, along with varying amplitudes. One method for increasing the number of control signals available by use of a state machine in the locomotive is disclosed in Severson, U.S. Pat. No. 4,914,431. Further, existing systems which impose DC voltage on top of AC line voltage suffer in that the DC signals detract from the power supplied to the train. Annoying surges in speed can occur as a result.

Another type of control system is shown in Hanschke et al., U.S. Pat. No. 4,572,996. This patent teaches sending address and control signals over a rail line bus to a train. The signals sent appear to be digital pulses. In Kacerek, U.S. Pat. No. 3,964,701, each train locomotive will respond to a different frequency signal. After the corresponding frequency signal is sent to alert the train, it is followed by a voltage level indicating the action to be taken.

Marklin makes a system which puts high power signals differentially between the tracks. These signals are used to provide power to the train's motor as well as for signalling control signals. Other systems use RF transmissions directly to the trains through the air. Still other systems will superimpose a high frequency signal on the track power signal that is applied differentially between the tracks. One problem with such systems is the intermittent contact between the wheels and the track, the noise generated by the brush motors used and intermittent contact due to gaps in the track. The RF transmitters which transmit directly to the trains have the disadvantage of requiring a large antenna, cost and complexity.

In addition to a desire to more accurately control their layouts, model vehicle enthusiasts also seek compatibility. More accurate control of a model vehicle can be achieved through new receiver and vehicle designs. One particularly desirable new design is described in co-pending and commonly-assigned application Ser. No. 08/134,102, filed Oct. 8, 1993, now U.S. Pat. No. 5,441,223. However, it is also desirable to provide compatibility so that enthusiasts may still utilize older model vehicles which do not contain sophisticated control circuitry. For example, older Lionel trains are responsive to track power changes and a single DC offset which controls a whistle. More recent Lionel trains are also responsive to track power changes but accept two DC offset signals (positive and negative offsets) to control a whistle and a bell. Even more recent trains may be retrofitted or designed with sophisticated receiver circuitry including microprocessors and the like. It is desirable to provide a transitional command and control scheme which permits a user to control old vehicle designs as well as new vehicles which have more sophisticated control circuitry.

SUMMARY OF THE INVENTION

The present invention provides a controller for model vehicles on a track. Remote control of existing model vehicle designs is accomplished by superimposing DC offset signals over AC track power. The DC control signals may then be picked up by existing or simple receiver circuitry located on the vehicle. The DC offset signals are generated without a corresponding reduction in track power, thus avoiding slippage or drops in the vehicle's speed. The DC offset signals may be provided to more than one vehicle on a single track and may also be used to control effects such as horns, whistles, or the like.

In one embodiment, the present invention is implemented using a power master unit placed between a track and a transformer. The power master unit receives transformed AC voltage, passes it through to the track, and imposes DC signals on the track voltage. The DC signals are created without any reduction in the overall power applied to the track. DC signals are created in response to commands entered via, e.g., a hand held remote control unit.

The present invention may be implemented on a track which also supports the use of vehicles which are controlled via an electromagnetic field. In this embodiment, the power master unit is coupled between the track and a transformer and a base unit or controller is also coupled to the track which generates electromagnetic control signals along the track. Trains equipped with special receiving circuitry are responsive to the control signals transmitted by the base unit or controller, while trains without the special receiving circuitry are responsive to the DC offset signals generated by the power master unit. Both types of trains, as well as other devices along the track, can be controlled using a hand held remote unit.

For a fuller understanding of the nature and advantages of the invention, reference should be made to the ensuing description taken in conjunction with the accompanying drawings.

DETAILED DESCRIPTION OF THE PREFERRED EMBODIMENTS

Figure 13:
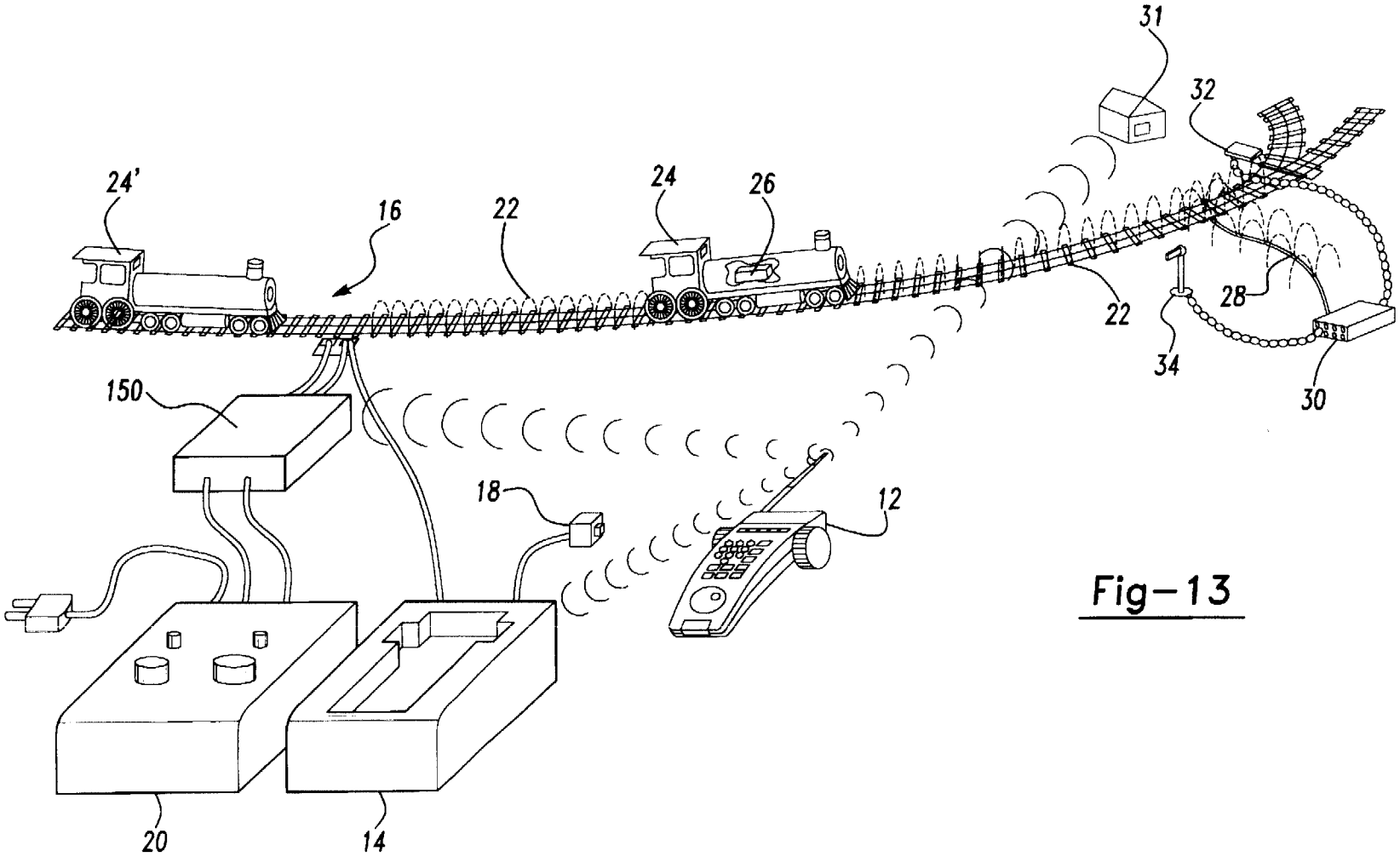
FIG. 13 is a perspective drawing of a layout of a train track system utilizing an embodiment of the present invention.

A description of one embodiment of the present invention will begin by first referring to FIG. 13, which is a perspective drawing of a layout of a train track system utilizing an embodiment of the present invention. A hand-held remote control unit 12 is used to transmit signals to a base unit 14 and to a power master unit 150 both of which are connected to train tracks 16. Base unit 14 receives power through an AC adapter 18. A separate transformer 20 is connected to track 16 to apply power to the tracks through power master unit 150. Power master unit 150 is used to control the delivery of power to the track 16 and also is used to superimpose DC control signals on the AC power signal upon request by command signals from the hand-held remote control unit 12.

Power master unit 150 modulates AC track power to the track 16 and also superimposes DC control signals on the track to control special effects and locomotive 24'. Locomotive 24' is, e.g., a standard Lionel locomotive powered by AC track power and receptive to DC control signals for, e.g., sound effects.

Base unit 14 transmits an RF signal between the track and earth ground, which generates an electromagnetic field indicated by lines 22 which propagates along the track. This field will pass through a locomotive 24 and will be received by a receiver 26 inside the locomotive an inch or two above the track. Locomotive 24 may be, e.g., a standard locomotive retrofitted or designed to carry a special receiver 26.

The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The use of both base unit 14 and power master unit 150 allows operation and control of several types of locomotives on a single track layout. Locomotives 24 which have been retrofitted or designed to carry receiver 26 are receptive to control signals delivered via base unit 14. Standard locomotives 24' which have not been retrofitted may be controlled using DC offset signals produced by power master unit 150. Trains may also be operated with one or the other of the two control systems. For example, in the system of FIG. 1 described below only the base unit 14 is used. Likewise, the power master 150 may be used on its own to control standard locomotives 24'. The result is a flexible control approach which allows the use of a single hand-held control unit to control different types and configurations of model vehicles.

Figure 14:
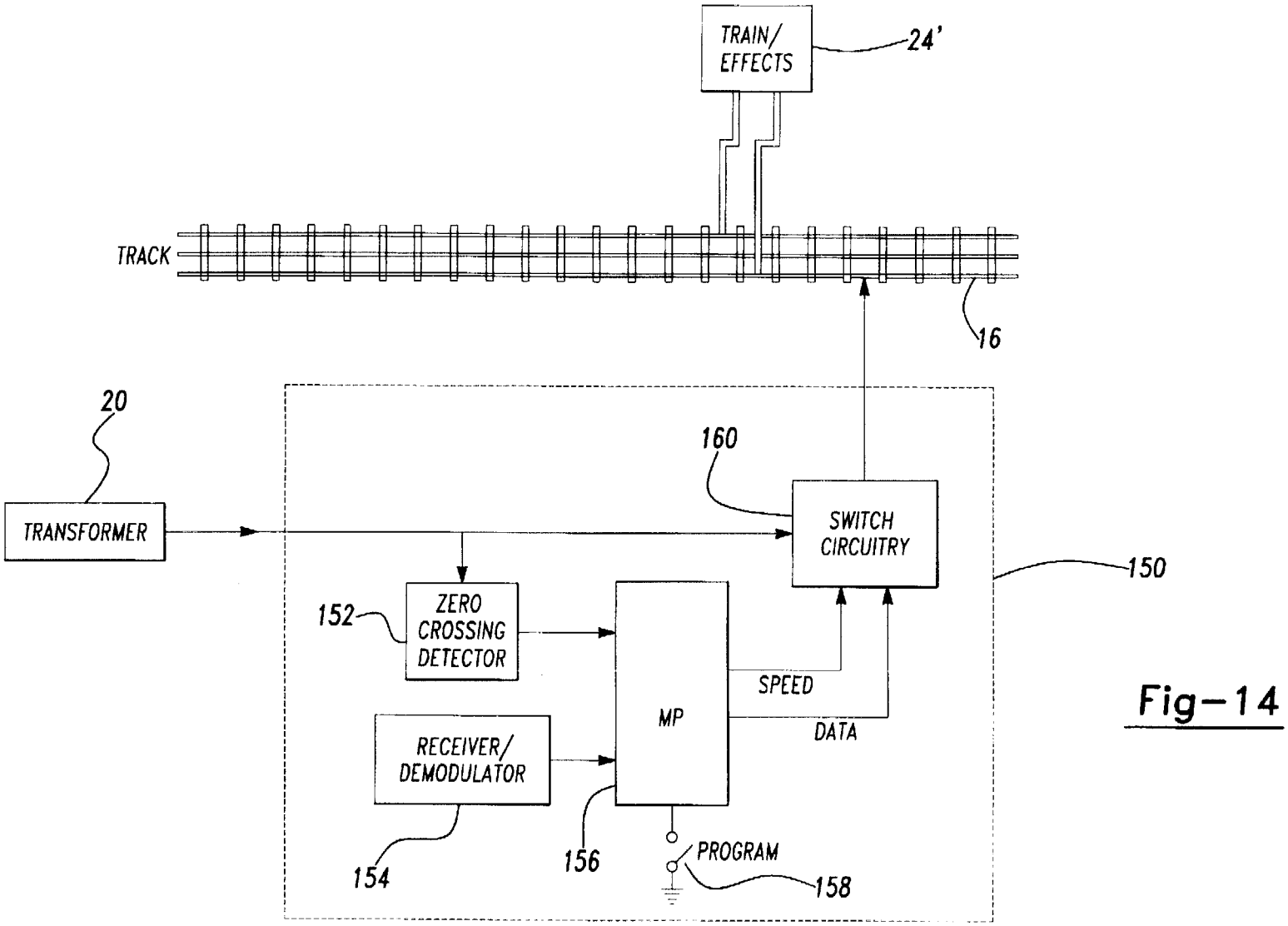
FIG. 14 is a block diagram of an embodiment of a power master unit according to the present invention.

FIG. 14 is a block diagram depicting features of one embodiment of a power master unit 150 according to the present invention. Again, the power master unit 150 is coupled to a transformer 20 and receives transformed AC line voltage. This signal is, in one specific embodiment, passed through the power master unit 150 to the track 16 to supply driving power to the locomotive 24 and/or 24'. The power master unit, upon command, superimposes DC signals on the track power using a phase shifting or switching scheme. In one specific embodiment, MOSFET transistors are used to perform the switching. Those skilled in the art will recognize that any similar switching scheme may be used which may be controlled to superimpose DC signals on track power as discussed herein.

When a command for the power master unit 150 is received from the hand-held remote control unit 12, it is received and demodulated by receiver/demodulator 154 and input to a microprocessor or microcontroller 156. The receiver is preferably an FM receiver chip such as the MC3361 manufactured by Motorola. The microcontroller is preferably a 16C84 microprocessor. Control pulses are provided to one or more switches 160 (e.g., MOSFETs or triacs).

Figure 10A:
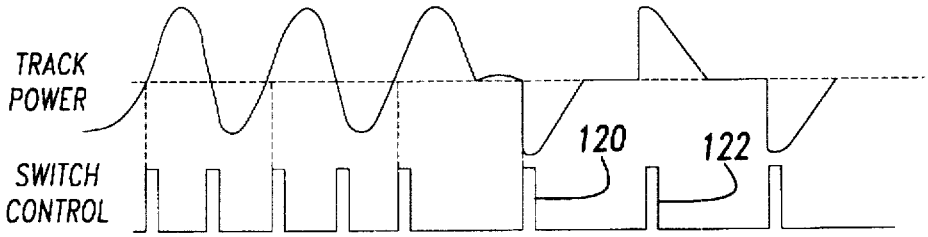
FIGS. 10A–10C are timing diagrams illustrating the control of the speed of a locomotive using a switching scheme of the present invention.
Figure 10B:
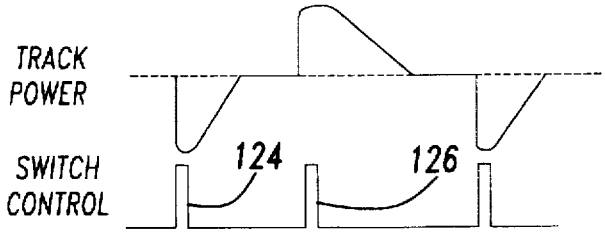
Figure 10C:
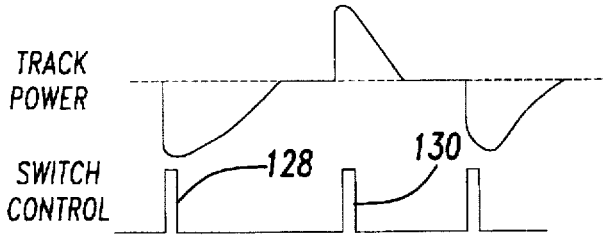

Power to the locomotives on the track is controlled by modulating the duty cycle of the waveform applied to the track. In one specific embodiment, an 18 Volt wave is applied to the tracks. FIG. 10A illustrates a track power signal which may be provided in several different embodiments of the present invention. Where a power master unit 150 is used, the track power signal shown in FIG. 10A may be provided as power to the track 16. If the power master unit is not used (as will be discussed infra) the track power signal is provided by an ordinary AC waveform carried on the track. The discussion here will focus on use of the power master unit 150. Switch control pulses from microprocessor 156 are shown in FIGS. 10A–C. In order to allow remote control of the power applied to the track, and thus the speed of the trains, transformer 20 is set to a maximum desired level. The AC power waveform is then modulated by the switches under the control of microprocessor 156, which is in turn controlled by the user from the remote control unit. As can be seen in the first part of FIG. 10, full power is input to the power master unit 150. The power master unit 150 then adjusts the effective power applied to the track by modulating the input waveform as instructed by the user commands received via the receiver/demodulator 154.

This is accomplished by turning on the output switches relative to each zero crossing of the power signal to turn the switch on in the positive or negative going direction, respectively. The microprocessor knows when to pulse the switch in a synchronized manner with the AC 60 Hz signal because in the preferred embodiment, communication is synchronized to the zero crossings using zero crossing detection circuitry 152 as is known in the art. When it is desired to decrease the power applied from the track, the pulses are simply applied after the zero crossing. When the AC signal crosses zero, it automatically shuts off, bringing its value to zero, until a switch is again pulsed by the microprocessor. Thus, when the switch is first varied, the signal goes to zero until it is pulsed by a pulse 120. Subsequently, the positive going pulse is also delayed to a time 122, thus cutting the amount of the positive part of the waveform as well. The power applied is equal to the area under the curves, which is cut almost in half in the diagram shown in FIG. 10A. By appropriately varying the timing, the power applied to the track can be controlled.

A DC offset can be applied to the track by appropriately controlling the switches using data signals from the microprocessor 156. As could be seen in FIG. 10A, the switch control pulses were equally spaced so that the positive and negative pulses would be even. By varying the phase, such as shown in FIG. 10B, an offset can be generated. As can be seen in FIG. 10B, a pulse 124 occurs relatively late after the negative-going zero-crossing, giving a small negative waveform. On the other hand, a pulse 126 occurs shortly after the positive-going zero-crossing, thus only clipping a small portion of the positive-going waveform. This gives an overall DC offset when the values are averaged. This DC offset is detected by circuitry or relays in the train itself. As can be seen, the pulses of FIG. 10B do double duty. They not only impose a DC offset, but also control the AC track power signal. The delay of the pulse after the zero crossing controls the track power while the differential between the negative going and positive going trigger pulses controls the amount of the DC offset. Evenly spaced pulses produce zero DC offset.

Similarly, FIG. 10C illustrates the imposition of a negative DC offset. A pulse 128 occurs shortly after the negative going zero crossing, while a pulse 130 occurs a longer time after a positive going zero crossing. This results in a net negative DC offset. results in a net negative DC offset.

By appropriately controlling the track power, a DC offset can be imposed without varying the power applied to the train, as required in prior art systems. Since it is the phase variation which causes the DC offset, the total area under the curve can be maintained to preserve the same power to the train. For instance, if a positive DC offset is imposed by clipping less of the positive signal or clipping more of the negative signal, the amount clipped can be controlled so that the total area is still the desired power. The greater amount clipped in a negative region is made up for by less being clipped in the positive region so that the overall power remains the same. This eliminates the annoying effect of having the train slow down when a DC offset is attempted to be applied to control the whistle or other effects on the train.

Track power modulated as described above may also be used to power locomotives 24 which have more sophisticated control circuitry. When track power is reduced using the power master unit 150, some user control of the speed of individual locomotives 24 is still possible. This provides great variation in train control over previous systems. Conventional locomotives 24' without sophisticated control circuitry may be controlled via the hand-held remote control 12 to some extent (e.g., speed, horn, and whistle). At the same time, and on the same track, newer locomotives 24 can be individually controlled with great precision.

Power master unit 150 may also include a program switch 158 which is, e.g., a two position switch movable between program and run positions. When moved to the program position, the hand-held remote unit 12 can be used to assign an address to that particular power master unit. This allows a number of devices to be controlled via a single remote unit. When the switch is placed in the run position, the power master unit 150 functions as normal to control the track power and DC offsets as described above. In the run mode, the microprocessor 156 will respond only to commands associated with that address.

Those skilled in the art will recognize that the power master unit 150 may be implemented on its own with a remote control unit as described to control a layout supporting conventional locomotives. The power master may also be used with an attached keyboard or other input means to control the speed and functions of conventional locomotives. In addition, the power master unit 150 may be implemented in systems supporting both conventional and newer locomotives enabling transitional command and control. One desirable control scheme which may be implemented using the same hand-held remote control unit 12 will now be described.

Figure 1:
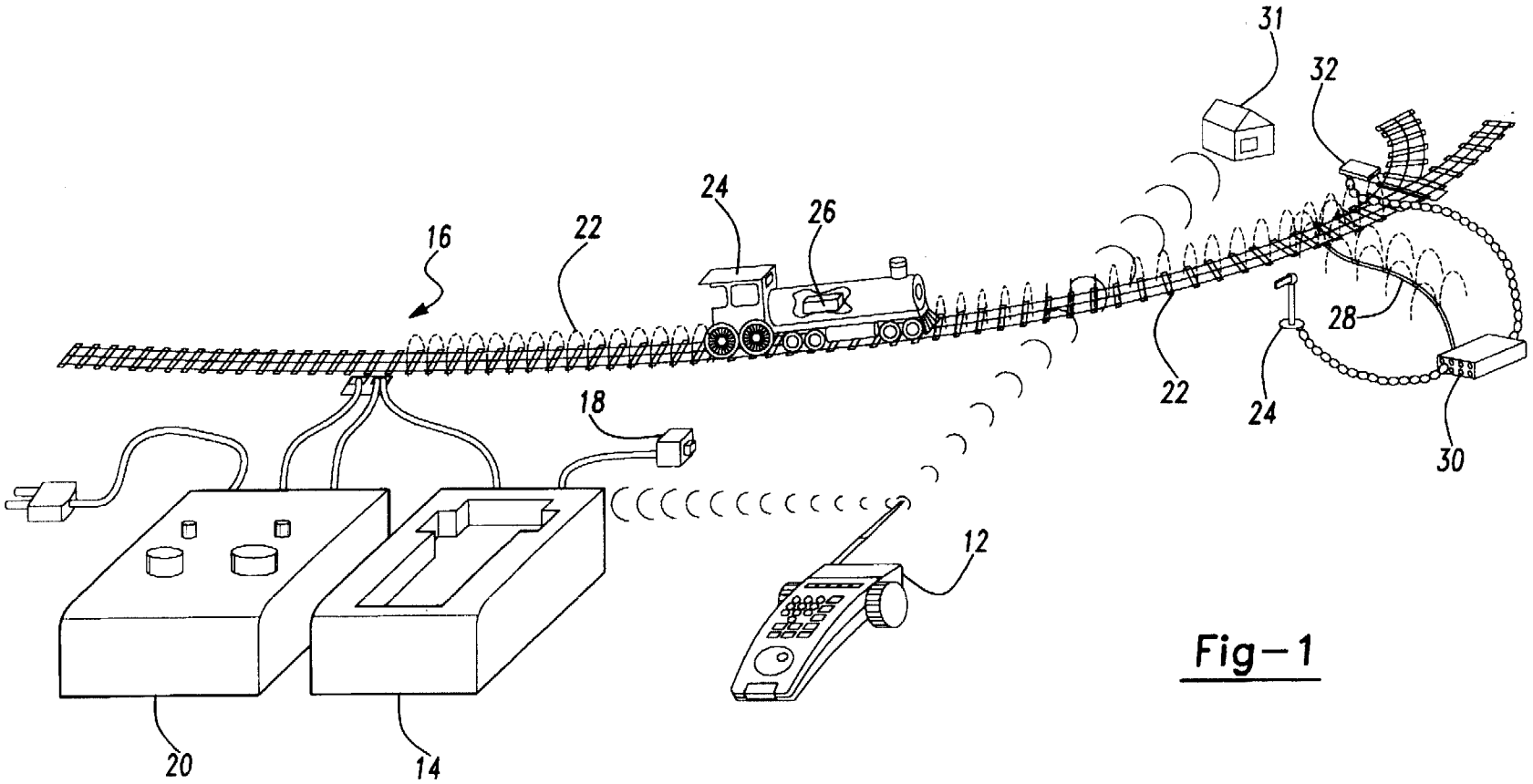
FIG. 1 is a perspective drawing of a layout of one embodiment of a train track system utilizing the present invention.

FIG. 1 is a perspective view of a train layout utilizing another embodiment of the present invention. A hand-held remote control unit 12 is used to transmit signals to a base unit 14 which is connected to train tracks 16. Base unit 14 receives power through an AC adapter 18. A separate conventional train transformer 20 is connected to track 16 to apply power to the tracks. In normal operation, the transformer is set on its full setting.

Base unit 14 transmits an RF signal between the track and earth ground, which generates an electromagnetic field indicated by lines 22 which propagates along the track. This field will pass through a locomotive 24 and will be received by a receiver 26 inside the locomotive an inch or two above the track.

The electromagnetic field will also propagate along a line 28 to a switch controller 30. Switch controller 30 also has a receiver in it, and will itself transmit control signals to various devices, such as the track switching module 32 or a moving flag 34.

Figure 2:
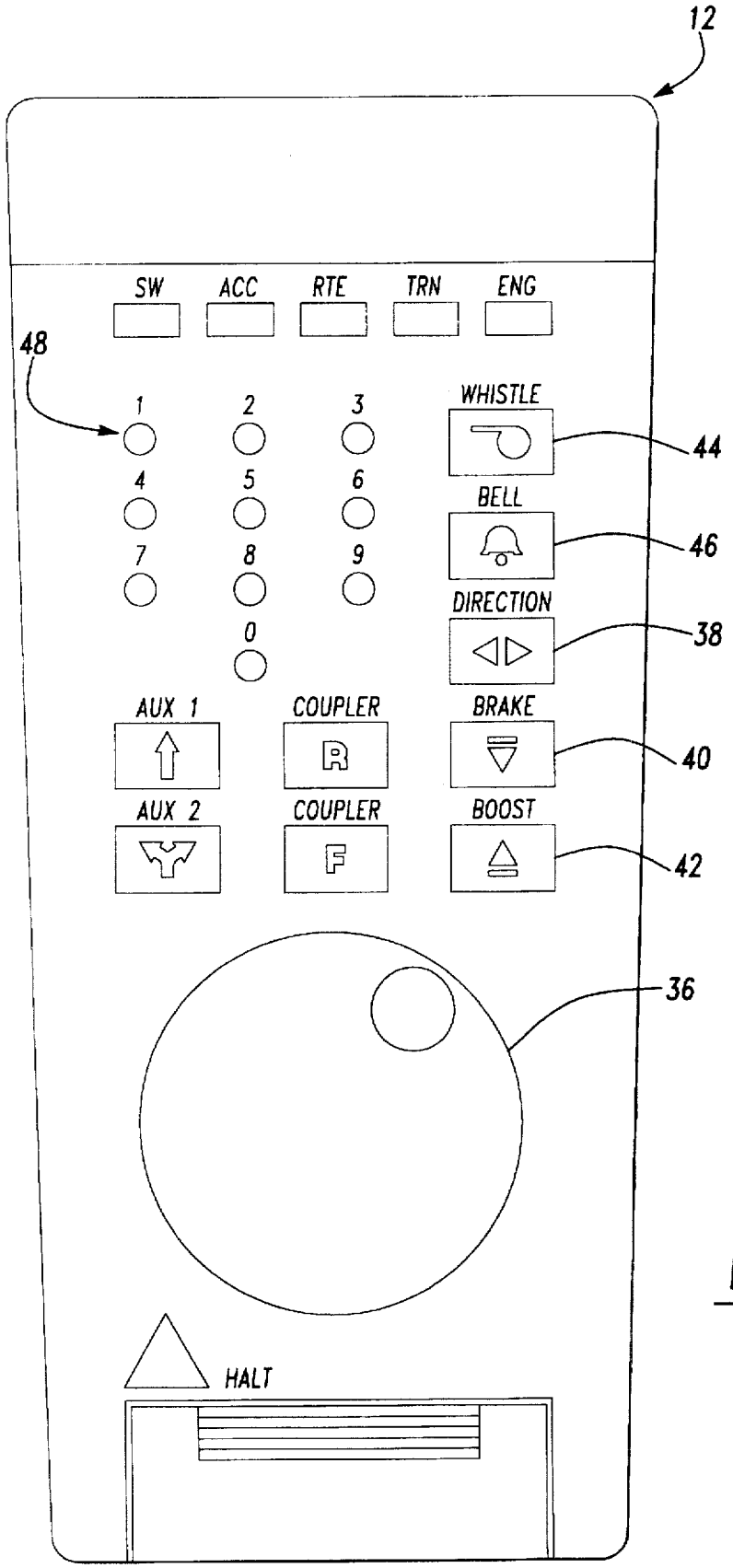
FIG. 2 is a diagram of the exterior of the hand-held remote control unit used for embodiments of the present invention.

FIG. 2 is a diagram of the housing for remote control unit 12 of FIGS. 1 and 13. The remote control contains a dial 36 which is used to adjust the speed of an engine. General purpose buttons are provided, as well as special purpose buttons. A direction button 38 allows the direction of a locomotive to be changed. Brake button 40 allows the train to be braked while the button is depressed, with the train returning to the speed set by dial 36 when the brake button is released. Similarly, boost button 42 will boost the train speed, with the train returning to its normal, slower speed set by dial 36. Boost button 42 may be used to give extra power to the train when going up a hill, for instance.

There is also a whistle button 44 and a bell button 46. A numeric key pad 48 allows alternate functions, such as the addressing of one of multiple trains.

Figure 3:
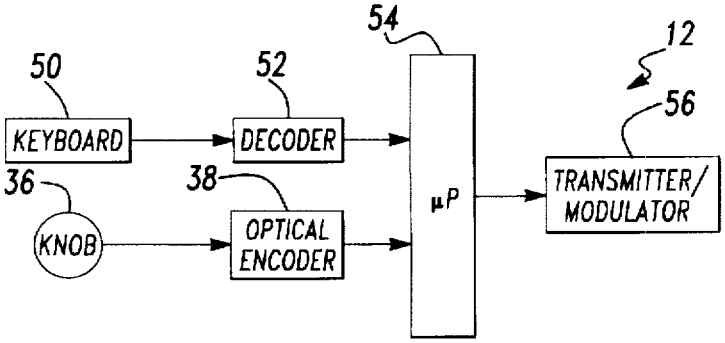
FIG. 3 is a block diagram of the electronics of the hand-held remote unit of FIG. 2.

FIG. 3 is a block diagram of the circuitry of the hand-held remote unit 12 of FIG. 2. The keyboard inputs 50 are provided through a decoder 52 to a microprocessor 54. The knob 36 for controller unit speed uses an optical encoder 38, similar to those used for computer mice or track balls. The output of optical encoder 38 is provided to microprocessor 54, which interprets the signals and provides them to a transmitter and demodulator 56 for transmission to the base unit. Transmitter/modulator 56 is preferably a radio transmitter.

Figure 4:
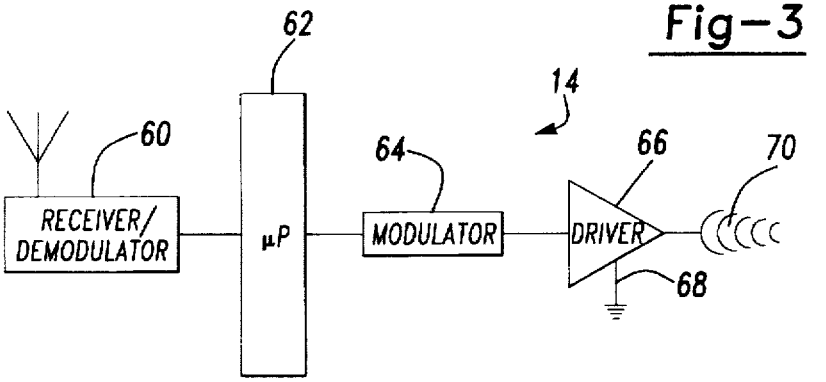
FIG. 4 is a block diagram of the base unit of FIG. 1.

FIG. 4 is a block diagram of base unit 14 of FIG. 1. A receiver/demodulator 60 receives the RF signals from the hand-held remote unit. These are provided to a microprocessor 62, which puts the commands in the proper form for transmission to the trains and then provides them to a modulator 64. Modulator 64 performs FM modulation and provides these signals through a driver 66 between earth ground 68 and a rail 70 of the track.

Figure 5:
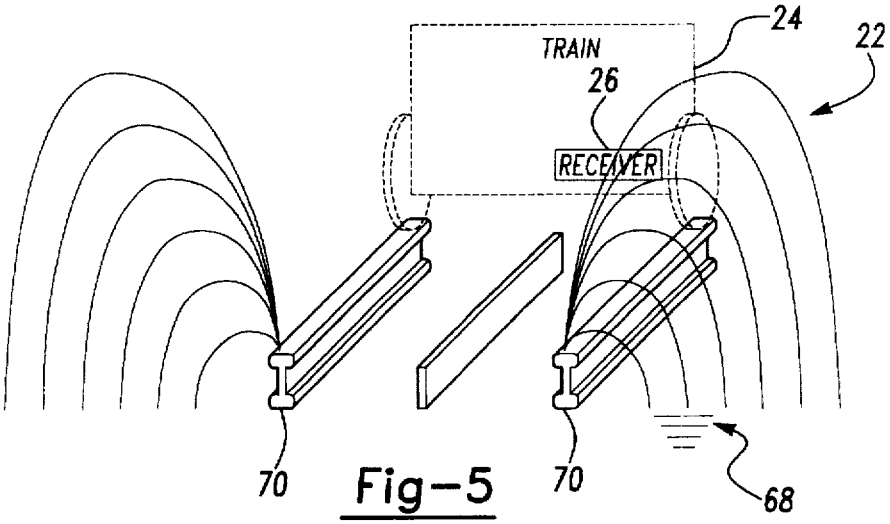
FIG. 5 is a diagram illustrating the generation of the electromagnetic field according to an embodiment of the present invention.

FIG. 5 illustrates in another view the electromagnetic field 22 generated between track rail 70 and earth ground 68. In the preferred embodiment, the signal used is a 455 Khz frequency shift keyed (FSK) signal at 5 volts peak-peak. This signal creates a field detectable within a few inches of the track. The field will propagate along the track, and be detected by a receiver 26 in a train locomotive 24.

Figure 6:
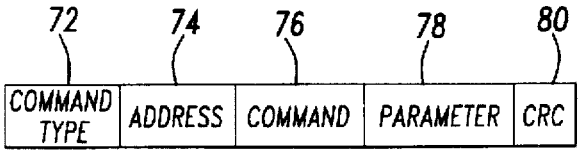
FIG. 6 is a diagram of the command protocol of embodiments of the present invention.

FIG. 6 shows the protocol used by the systems of FIGS. 1 and 13. A message transmitted by hand-held remote 12 and received by base unit 14 or power master unit 150 will have the fields set forth in FIG. 6. A command-type field 72 identifies the type of command. For example, a first command-type would be for the system controller 30. A second command-type would be for a transmission to the trains. The second field 74 sets forth the address. For example, if the command is for the trains, the address will set forth a particular train to which it is to be directed. Alternately, for the switch controller command, it will designate which of the remote switches is to be activated. Another command type may be used for the power master unit 150.

The next field 76 is the command itself. For example, it might say to increase the track power or activate a certain sound module. The following parameter field 78 would then indicate the parameters of the command, such as the level to which power to the train motor is to be increased or the amount or frequency of the sound to be generated. The last field contains a cyclic redundancy code (CRC) 80 which is used for error checking.

The use of the same protocol throughout the system allows for the distributed processing accomplished in the systems of FIGS. 1 or 13. Each control node can look at the different fields of the protocol. For instance, microprocessor 62 in base unit 14 will direct the message according to the command-type 72. The trains on the track (or the power master unit 150) will receive it in accordance with the address, and then decode it for the command parameter.

The command type 72 might indicate that it was intended for direct receipt by, for instance, sound module 31 on the train track layout. This sound module could have its own detector, and respond to only a certain command type. The base unit of FIG. 4 can operate with several hand-held remote units. Each hand-held remote can transmit a signal to the base unit, and, in one embodiment, may use the command type field 72 to indicate which hand-held remote it is. Alternately, different frequencies can be assigned to different hand-held remote units. Microprocessor 62 of base unit 14 will monitor for collisions between two hand-held remote units transmitting at the same time. If a collision is detected, the signal will be ignored until a retransmission in the clear by one of the hand-held remote units is received. The likelihood of collisions is fairly limited with a small number of hand-held remote units.

Figure 7:
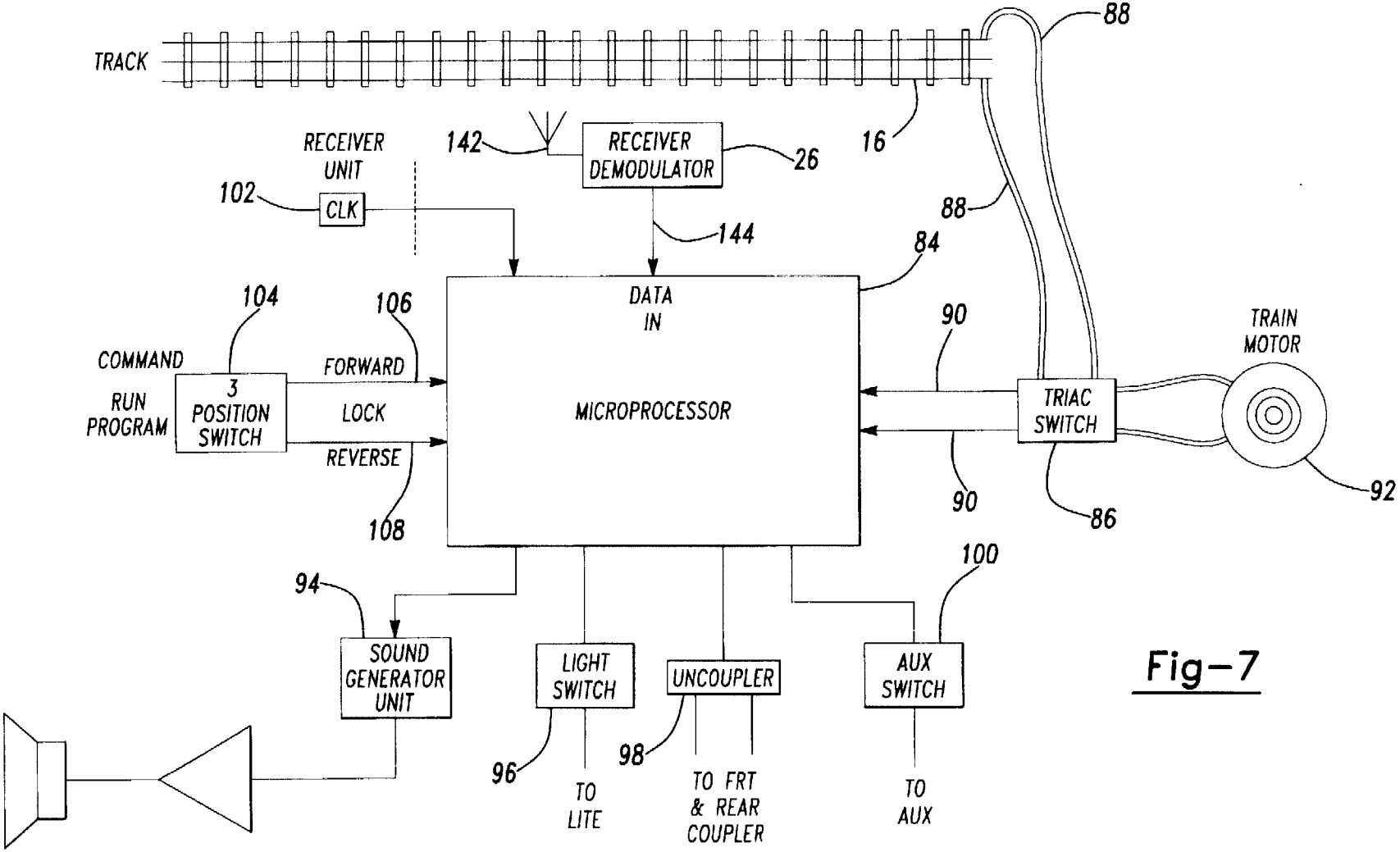
FIG. 7 is a block diagram of the receiver and controller circuitry on a locomotive according to one embodiment of the present invention.

FIG. 7 is a block diagram of the circuitry inside of a train 24 running on track 16. A receiver demodulator circuit 26 picks up the electromagnetic field signals, and provides them to a data input of a microcontroller 84. The receiver is preferably an FM receiver chip such as the MC3361 manufactured by Motorola. The microcontroller is preferably a 16C84 microprocessor. The microprocessor controls a triac switching circuit 86. One side of the triac switches are connected to the train tracks through leads 88 which pick up power physically from the track. When activated by control signals from microcontroller 84 on lines 90, the triac switching circuit 86 will provide power to train motor 92, which moves the wheels of the train.

The microcontroller also has separate, dedicated output pins which can control a sound generator unit 94, a light switch 96, a coupler 98 and an auxiliary switch 100. The microcontroller is powered by an on-board clock 102.

A three position manual switch 104 is provided. In a first mode, the switch indicates on a line 106 that the train is to start in the forward direction. When in a second position, a signal on a line 108 indicates that the train is to start in the reverse direction. When the switch is in-between the two lines, in a "lock" mode, the microcontroller knows to start the train in the last direction it was in.

The same switch 104 can perform a second function. When a control command is received by the microcontroller, it knows to use the position of switch 104 to indicate either a "run" mode when the switch is in position 106, or a "program" mode when the switch is in the position on line 108.

In order to program an address into a train, the manual switch is moved into the program mode and the train is put on the track. The remote unit is then used to provide an address program command with a designated address for that train. This command is received by the receiver 26 and provided to microcontroller 84, which knows it should write into its memory that address as its designated address. Thereafter, in the run mode, the microcontroller will respond only to commands associated with that address.

Figure 8:
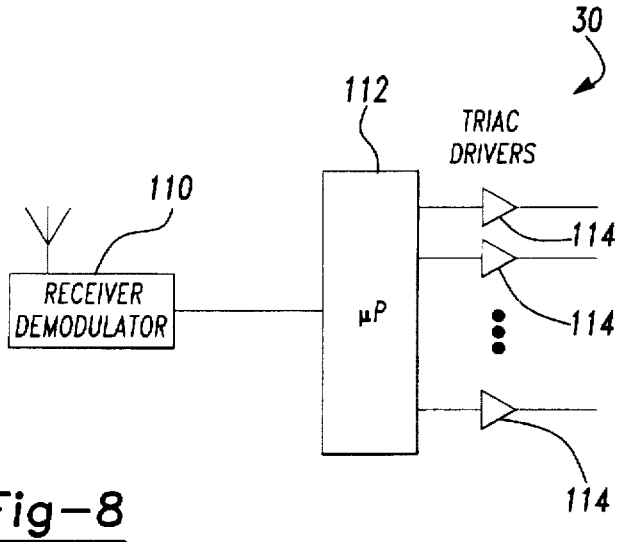
FIG. 8 is a diagram of a switch controller coupled to the tracks of the present invention.

FIG. 8 is a block diagram of the switch controller 30 of FIG. 1, which is a simplified version of the circuitry in the train in FIG. 7. The switch controller contains a receiver/demodulator 110, which is coupled to a microprocessor 112. The microprocessor would drive an appropriate one of triac drivers 114, which couple power to the different track switches, lights, etc. around the track system. Microprocessor 112 can be a simple controller or a decoder in one embodiment.

Figure 9:
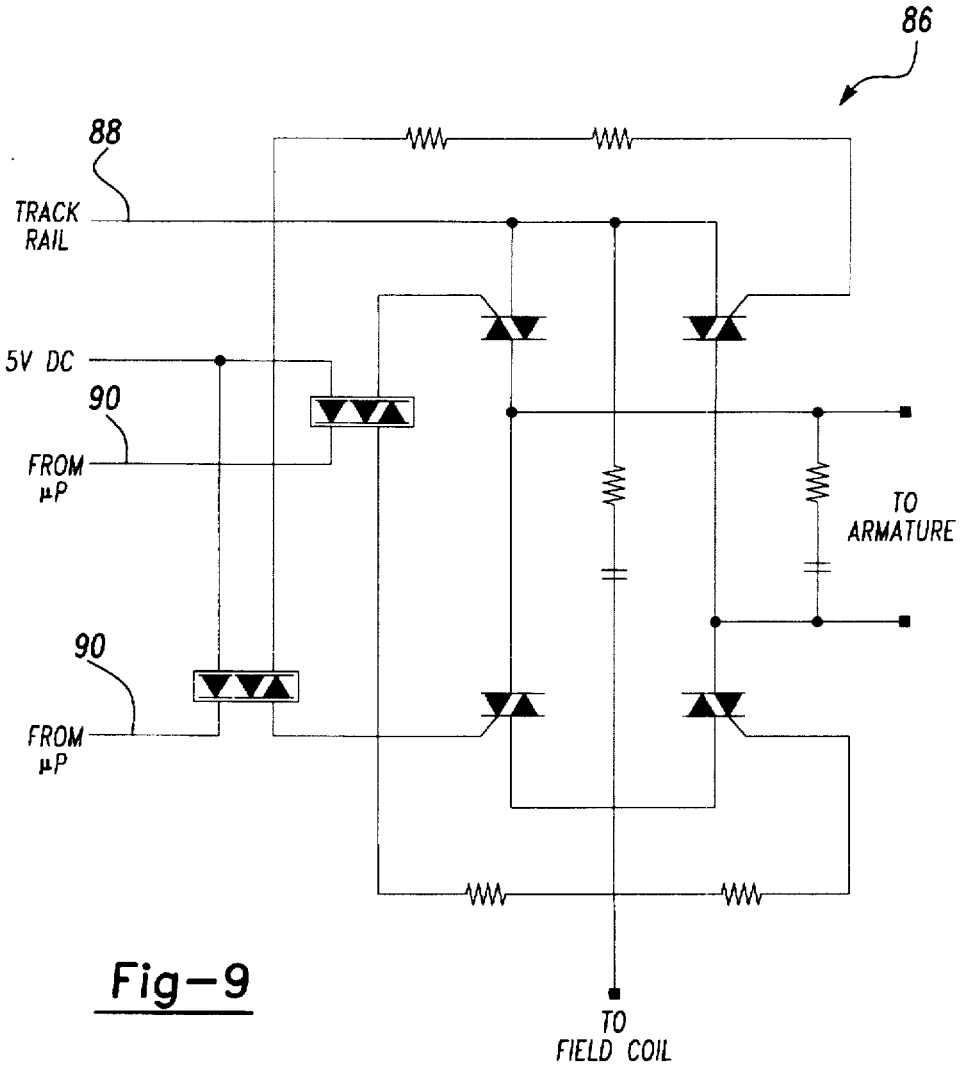
FIG. 9 is a circuit diagram of the triac switch circuit of FIG. 7.

FIG. 9 is a circuit diagram illustrating a preferred embodiment of the triac switch circuit 86 of FIG. 7. The triac switches switch the connections between the armature and field coils of the motor to reverse its direction in accordance with control signals received on lines 90 from the microprocessor. The circuitry, described above for use in the power master unit 150, may also be used in updated locomotives 24 to permit individual adjustment of a locomotive's speed. This will be described by again referring to the waveforms of FIG. 10.

FIG. 10A illustrates the track power signal provided to the train motor 92 as it is controlled by the triac switch circuit 86. The triac control pulses from microprocessor 84 are shown immediately below. In order to allow remote control of the power applied to the motor, and thus the speed of the trains, transformer 20 of FIG. 1 is set to a maximum desired level. The AC power waveform is then modulated by the triac switches under the control of microprocessor 84, which is in turn controlled by the user from the remote control unit. As can be seen, in the first part of FIG. 10, full power is applied to the track. This is accomplished by pulsing the triac at each zero crossing of the power signal to turn the triac on in the positive or negative going direction, respectively. The microprocessor knows when to pulse the triac in a synchronized manner with the AC 60 Hz signal because in the preferred embodiment, communication is synchronized to the zero crossings. When it is desired to decrease the power applied from the track, the pulses are simply applied after the zero crossing. When the AC signal crosses zero, it automatically shuts off, bringing its value to zero, until it is pulsed by the triac. Thus, when the triac control is first varied, the signal goes to zero until it is pulsed by a triac pulse 120. Subsequently, the positive going triac pulse is also delayed to a time 122, thus cutting the amount of the positive part of the waveform as well. The power applied is equal to the area under the curves, which is cut almost in half in the diagram shown in FIG. 10A. By appropriately varying the timing, the power received from the track can be controlled.

Figure 11:
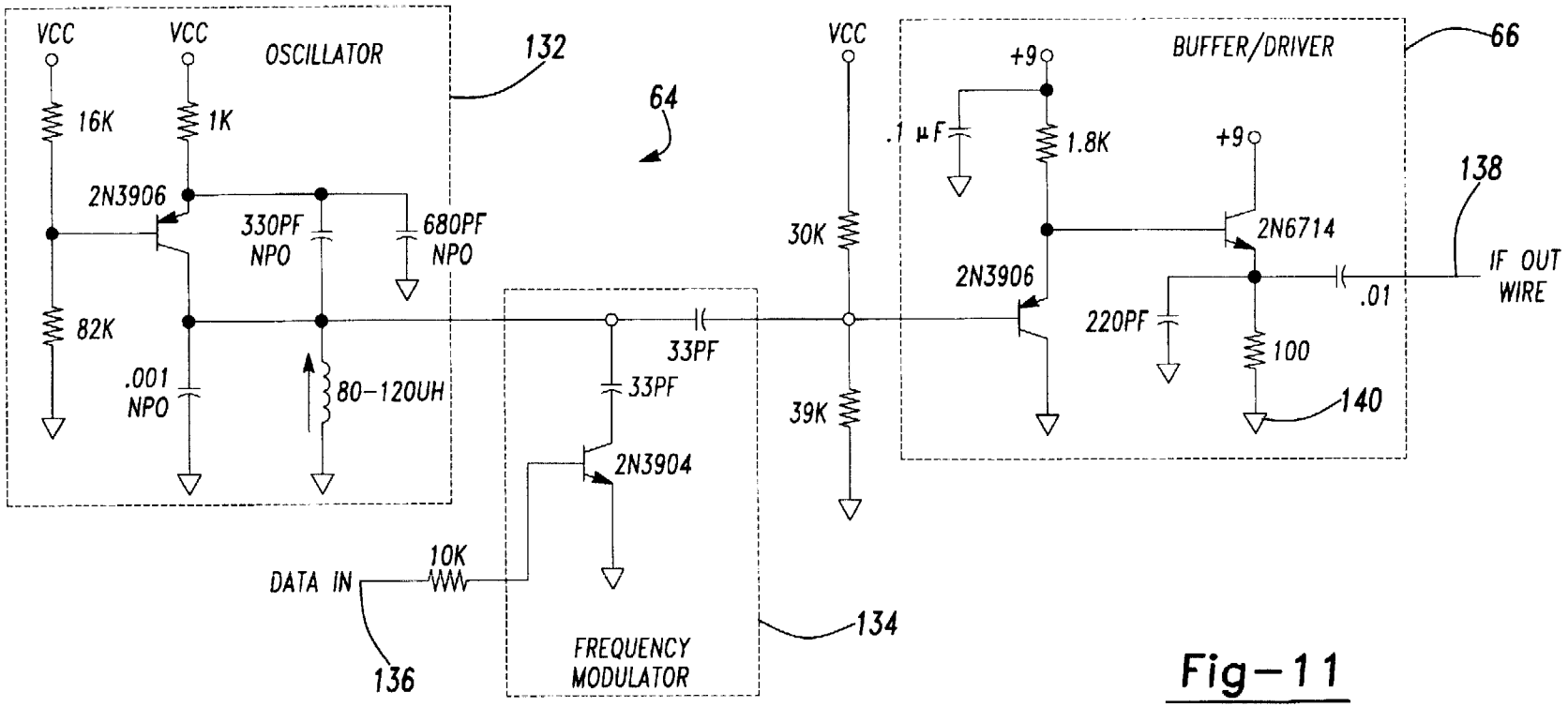
FIG. 11 is a circuit diagram of the modulator and driver blocks of the base unit of FIG. 4.

FIG. 11 is a circuit diagram of a base unit modulator and driver circuitry. The modulator 64 is composed of an oscillator 132 and a frequency modulator 134, which receives the data input from microprocessor 62 of FIG. 4 on line 136. A buffer/driver circuit 66 provides the output signal to the train track between line 138 connected to the rail of the track and earth ground 140.

Figure 12:
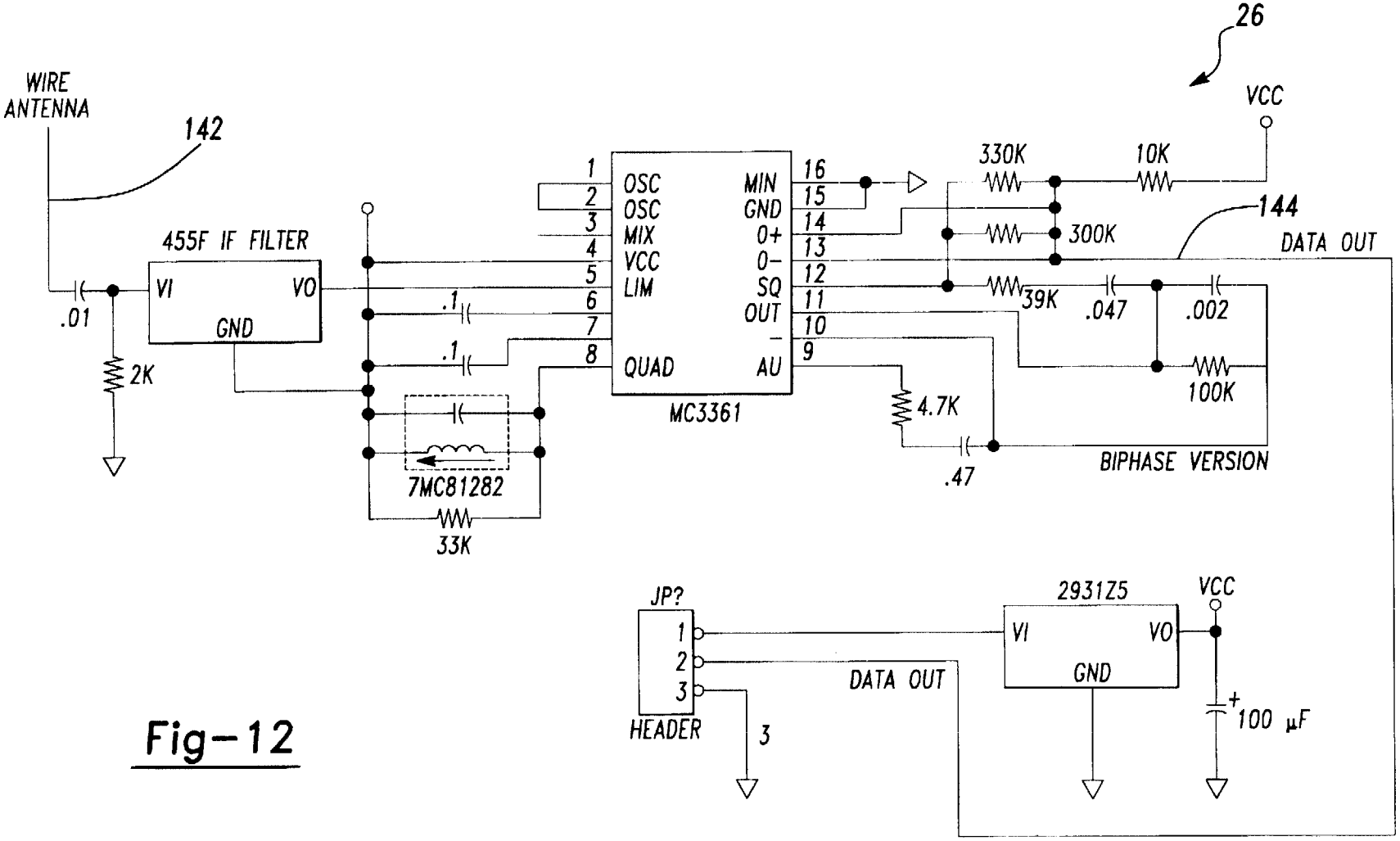
FIG. 12 is a circuit diagram of the train receiver/demodulator block of FIGS. 7 and 14.

FIG. 12 is a circuit diagram of the train receiver/demodulator circuit 26 of FIG. 7. Signals are received via a wire antenna 142 and provided on an input 144 to microprocessor 84 of FIG. 7.

As will be understood by those familiar with the art, the present invention can be embodied in other specific forms without departing from the spirit or essential characteristics thereof. For example, a frequency other than 455 Khz could be used for the transmission along the train track. Alternately, a transmission method other than radio can be used from the remote to the base unit and power master unit, such as an IR signal. In addition, the invention could be applied to vehicles other than model trains which run on a track. Accordingly, the disclosure of the preferred embodiment of the invention is intended to be illustrative, but not limiting, of the scope of the invention which is set forth in the following claims.

What is claimed is:

1. A control system for transmitting control signals to an alternating current (AC) powered first model vehicle on a track, comprising:

a hand-held remote transmitter for transmitting user input signals;

input means for receiving said user input signals;

first control means, coupled to said input means, for generating direct current (DC) control signals for said first model vehicle; and a transmitter means, coupled to said first control means and to said track, for transmitting said DC control signals such that said DC control signals can be received by circuitry on said first model vehicle; and said control system further controlling at least a second model vehicle, the system comprising:

second control means, coupled to said track and responsive to said user input signals from said hand-held remote transmitter, for generating electromagnetic control signals along said track; and receiving means, located on said second model vehicle, for receiving said electromagnetic control signals, and directing the operation of said second model vehicle in response to said electromagnetic control signals.

2. The control system of claim 1 further comprising a transformer coupled to two rails of said track for providing AC power to said track.

3. The control system of claim 1 further comprising a horn responsive to said DC control signals received by said circuitry on said first model vehicle.

4. The control system of claim 1 further comprising a whistle responsive to said DC control signals received by said circuitry on said first model vehicle.

5. The control system of claim 2 wherein said DC control signals are superimposed on said AC power to said track without causing a reduction in overall power supplied to the model vehicles.

6. The control system of claim 1 wherein said hand-held remote transmitter permits remote control of the speed of said first and second model vehicles.

7. A control system for transmitting control signals to an alternating current (AC) powered first model vehicle on a track, comprising:

an input device for accepting user input signals;

first control circuitry, coupled to said input device, for generating direct current (DC) control signals for said first model vehicle;

second control circuitry, coupled to said user input device and said track, for generating electromagnetic control signal along said track;

a transmitter, coupled to said first control circuitry, for transmitting said DC control signals such that said DC control signals can be received by a receiver on said first model vehicle;

circuitry means on said first model vehicle for receiving said DC control signals; and an electric motor for driving said first model vehicle based upon AC signals on said track.

8. The control system of claim 7 wherein said first control circuitry includes at least a first switch for generating said DC control signals.

9. The control system of claim 8 wherein said first control circuitry further includes a microprocessor responsive to said user input signals for controlling said at least a first switch.

10. The control system of claim 7 wherein said DC control signals operate at least a first special effect on said first model vehicle.

11. The control system of claim 7 wherein a speed of said first model vehicle may be controlled remotely.

12. The control system of claim 7 wherein a second model vehicle is controlled on said track, the second model vehicle comprising receiving means for receiving said electromagnetic control signals, wherein operation of said second model vehicle is controlled by said electromagnetic control signals.

13. A control system for at least first and second model vehicles on a track system comprising:

a hand-held remote control unit for transmitting first and second control signals;

a transformer for applying alternating current (AC) track power to said track;

a power unit, connected to said track, for receiving said first control signals, and providing direct current (DC) control signals to said track without an overall reduction in AC track power;

a base unit, connected to said track, for receiving said second control signals, and providing electromagnetic control signals along said track;

a first vehicle receiver unit, mounted in said first model vehicle, for receiving said DC control signals, and directing the operation of said first model vehicle in response to said DC control signals; and a second vehicle receiver unit, mounted in said second model vehicle, for receiving said electromagnetic control signals and directing the operation of said second model vehicle in response to said electromagnetic control signals.

* * * * *